US006137989A

United States Patent [19]

Quesnel

[11] Patent Number: 6,137,989

[45] Date of Patent: Oct. 24, 2000

[54] SENSOR ARRAY AND METHOD TO CORRECT TOP EDGE MISREGISTRATION

[75] Inventor: Lisbeth S. Quesnel, Pittsford, N.Y.

[73] Assignee: Xerox Corporation, Stamford, Conn.

[21] Appl. No.: 09/060,848

[22] Filed: Apr. 15, 1998

[51] Int. Cl.[7] ..... G03G 15/00

[52] U.S. Cl. ..... 399/394; 347/248; 399/395

[58] Field of Search ..... 271/228; 347/234, 347/235, 248, 250; 399/388, 394, 395

[56] References Cited

U.S. PATENT DOCUMENTS

| | | | |
|---|---|---|---|
| 4,712,118 | 12/1987 | Seto et al. | 347/248 |
| 4,755,855 | 7/1988 | Watanabe | 399/394 |
| 4,814,792 | 3/1989 | Yamanobe et al. | 347/248 |
| 5,140,340 | 8/1992 | Stephenson | 347/177 |
| 5,273,274 | 12/1993 | Thomsen et al. | 271/228 |
| 5,681,036 | 10/1997 | Wakahara et al. | 217/10.12 |
| 5,697,609 | 12/1997 | Williams et al. | 271/228 |

*Primary Examiner*—William J. Royer
*Attorney, Agent, or Firm*—Kevin R. Kepner; William F. Eipert

[57] ABSTRACT

An apparatus and method for correcting top edge sheet misregistration using a sensor array. An array sensor is placed in the paper path prior to transfer. A signal is generated indicating the position of the sheet. As a function of the signal the print controller causes the image to be exposed and developed on the photoreceptor in alignment with the sheet position. The aligned image is then transferred to the sheet.

6 Claims, 3 Drawing Sheets

SENSOR ARRAY AND METHOD TO CORRECT TOP EDGE MISREGISTRATION

This invention relates generally to an apparatus and method for sheet registration in an electrophotographic printing machine, and more particularly concerns an improved apparatus and method for correcting top edge misregistration.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In printing machines such as those described above it is necessary to place the image with some precision on each sheet. This requires the ability to register a sheet with respect to the transfer station. Sheet registration of the top edge or inboard to outboard edge of the print, can be achieved in several ways. Edge registration, such as with crossed rolls, registers the top edge of the sheet by moving the sheet in a diagonal direction so that it eventually contacts against a side registration edge. The sheet is then transported forward in the process direction by servo motors which bring the sheet to transfer at the right time and at the right velocity. Translating electronic registration schemes utilize two or three stepper motors which deskew the lead edge and simultaneously register the top edge of the sheet and then deliver the sheet at the right velocity to transfer. The most inexpensive registration method is stalled roll deskew, whereby the sheet lead edge travels into a non-moving or stalled roll nip. The body of the sheet continues to move forward, pushing the lead edge forward so that it aligns eventually with the nip. When the stalled nip is activated, such as by an electromechanical clutch, the lead edge of the sheet, now deskewed, moves forward, and the body follows naturally.

Estimated costs of the these three systems are approximately several hundred dollars for crossed rolls with servo or the translating electronic registration system with stepper motors, and nearly one hundred dollars for the stalled roll registration system. The stalled roll registration system is by for the most economical and is also the most frequently used registration system in mid to low cost printer/copiers. The stalled roll registration system, however, does not correct for top edge misregistration.

The following disclosures may relate to various aspects of the present invention.

U.S. Pat. No. 4,519,700

Patentee: Barker et al.

Issue Date: May 28, 1985

U.S. Pat. No. 5,273,274

Patentee: Thomson et al.

Issue Date: Dec. 28, 1993

U.S. Pat. No. 5,678,159

Patentee: Williams et al.

Issue Date: Oct. 14, 1997

Some portions of the foregoing disclosures may be briefly summarized as follows:

U.S. Pat. No. 4,519,700 describes a xerographic image transfer device in which copy sheets are sequentially aligned and position sensed before introduction to the image transfer zone. The position sensing is used to compare the copy sheet location with the position of the image panel on a moving photoconductor. The timing and velocity profile of the copy sheet drive after the position sensing is arranged so that the copy sheet arrives in registry with the image panel and at the same velocity.

U.S. Pat. No. 5,273,274 describes a sheet feeding and lateral registration system including feed rollers for feeding sheets in a process direction and registration apparatus for registering each sheet in a direction laterally of the process direction. The registration apparatus includes a shifting system for laterally shifting a carriage on which the feed rollers are mounted. A single edge sensor is arranged to provide a signal on detecting the presence of a sheet, and a controller controls the lateral shifting system in response to that signal. The controller is operated such that if the sheet is not detected by the sensor on initial entry of the sheet into the feed rollers, then the shifting system is activated to move the feed rollers laterally towards the sensor until the sheet is detected by the sensor, whereupon the lateral movement is stopped. If the sheet is detected by the sensor on initial entry of the sheet into the system, then the shifting system is activated to move the feed rollers laterally away from the sensor until the sensor no longer detects the sheet, and then the shifting system is reverse activated to laterally move the feed rollers back towards the sensor until the sheet is again detected by the sensor.

U.S. Pat. No. 5,678,159 describes a deskewing and registering device for an electrophotographic printing machine. A single set of sensors determine the position and skew of a sheet in a paper path and generate signals indicative thereof. A pair of independently driven nips forward the sheet to a registration position in skew and at the proper time based on signals from a controller which interprets the position signals and generates the motor control signals. An additional set of sensors can be used at the registration position to provide feedback for updating the control signals as rolls wear or different substrates having different coefficients of friction are used.

In accordance with one aspect of the present invention, there is provided an apparatus to correct misregistration of a sheet in a printer, comprising an array sensor, to measure the position of a sheet and to generate a signal indicative thereof, a controller, to receive the signal from said sensor and to generate a corrected print signal as a function thereof and a print engine, responsive to the signal from said controller to create marks on a sheet in proper registration on the sheet.

Pursuant to another aspect of the present invention, there is provided an electrophotographic printing machine having an apparatus to correct misregistration of a sheet in a printer, comprising an array sensor, to measure the position of a sheet and to generate a signal indicative thereof, a controller, to receive the signal from said sensor and to generate a corrected print signal as a function thereof and a print engine, responsive to the signal from said controller to create marks on a sheet in proper registration on the sheet.

Pursuant to yet another aspect of the present invention, there is provided a method of determining the position of and correcting misregistration of a sheet in a printer, comprising measuring the position of a sheet with an array sensor and generating a signal indicative thereof, generating a corrected print signal as a function of the signal from said sensor and creating marks on a sheet in proper registration on the sheet responsive to the generated corrected print signal.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
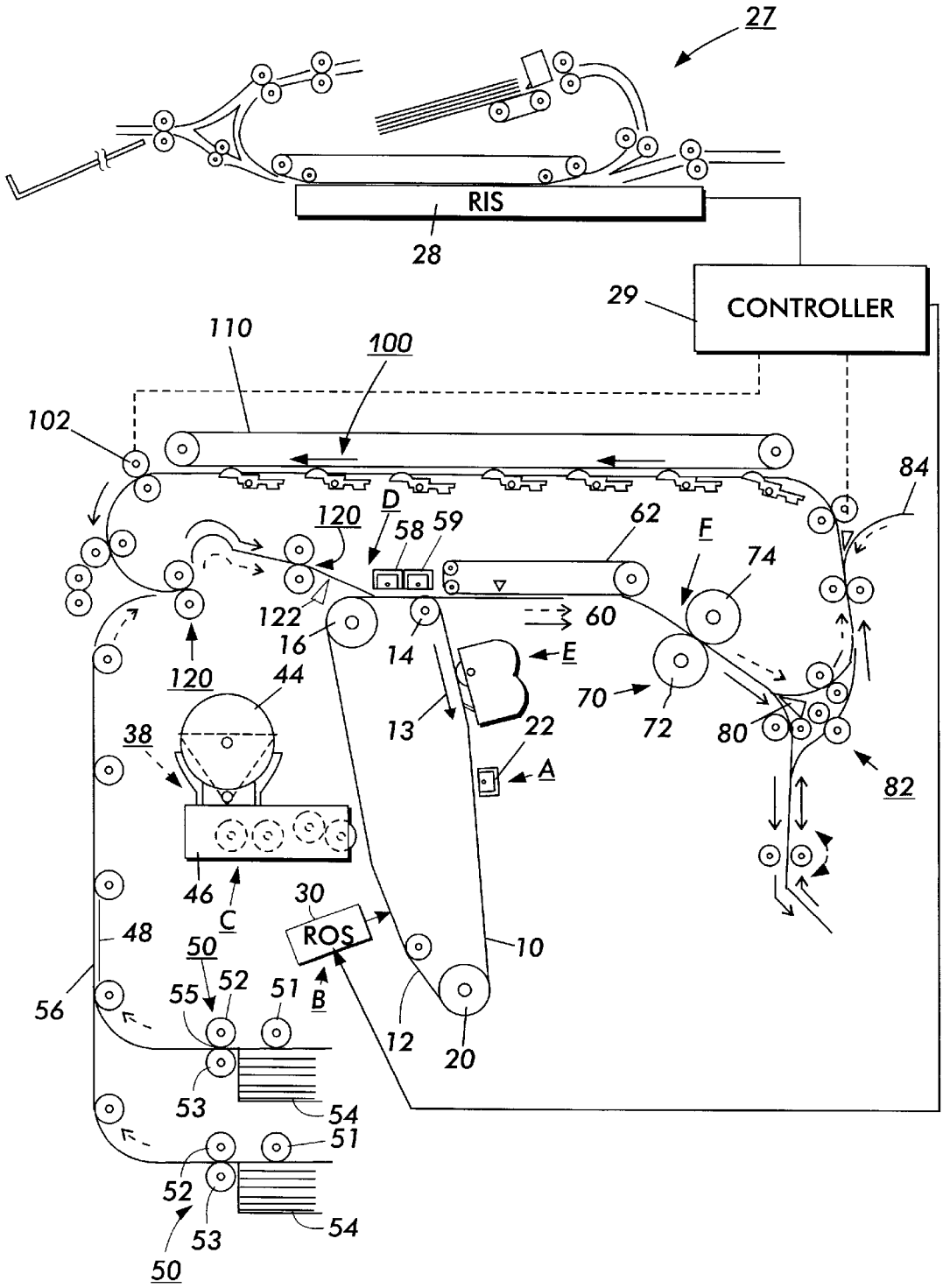
FIG. 1 is a schematic elevational view of a typical electrophotographic printing machine utilizing the sheet deskew and registration device of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the sheet deskew and registration device of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 using the array sensor of the invention herein, described in detail below, past image transfer station D to receive an image from photoconductive belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transport 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
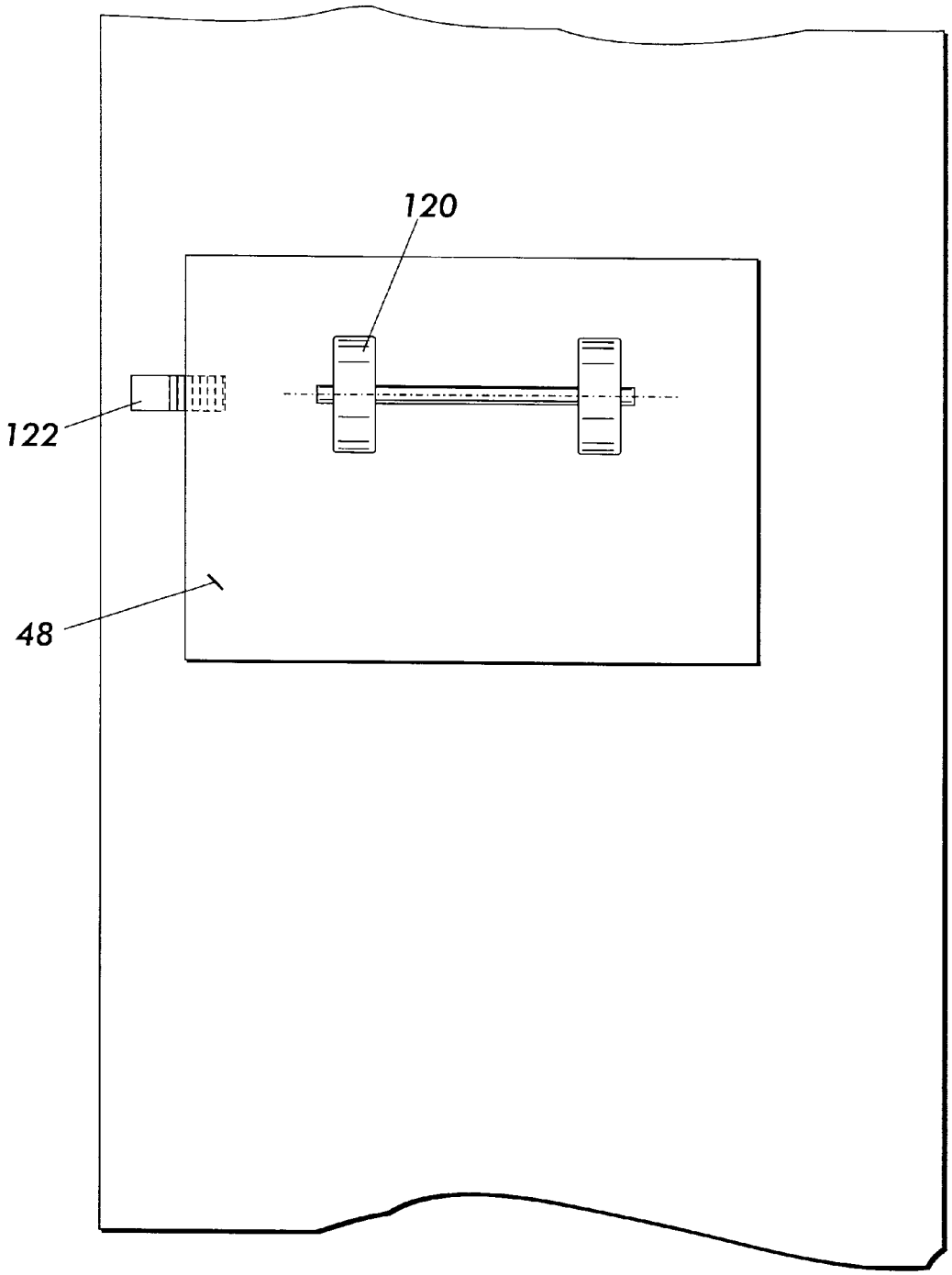
FIG. 2 is a top view of the pretransfer sheet path area illustrating the array sensor and method of the present invention.

As illustrated in FIG. 2, a relatively inexpensive method to correct for top edge misregistration is to utilize array sensors 122, measure the sheet's top edge location, and then adjust the image to the sheet 48. This is ideally well suited for digital printers/copiers. The image top edge position is adjusted on the photoreceptor by adjusting the signal for the ROS "start of scan". An array sensor 122 is a charge coupled device which has an image sensing area consisting of a variable number of horizontal image lines each containing a variable number of photosensitive elements or pixels. A single array sensor would have n×1 number of pixels, for instance. The required width of the array sensor depends on the variation in paper sizes and also on whether the paper path is edge or center registered. An edge registered paper path requires a very small array sensor. For instance, if the expected input variation is +/−10 mm, then the array sensor would be 20 mm. A center registered paper path, such as in the XEROX 265DC printer, requires a wider array sensor. The expected input variation is added to the variation in paper widths. For instance, to correct for sheets with a width range of A5 to 11 inches wide, the sensor should be 35 mm wide plus the expected misregistration, or 35+20=55 mm total.

The array sensors 122 can be utilized either in reflective mode or in transmissive mode. In the reflective mode, light is emitted from LED's or other light sources, reflects off the paper or other sheet medium, and is reflected back to the pixels, generating a charge level in each pixel. The charge level is proportional to the amount of light reflected and the length of exposure time. This value is then determined for each pixel. The pixels which are covered by the edge of the paper will have different values than the pixels left uncovered. In the transmissive mode, the paper is located between the light source and the pixels. The mode normally used is the auto-reflective mode. An analog voltage level which is linearly proportional to the number of pixels covered by the edge of the paper will allow the appropriate ROS start of scan to be adjusted. The accuracy of the registration can be adjusted or changed by changing the number of pixels in the sensor. The more pixels, the finer the accuracy.

Since this is administered "on the fly", adjustments can be made sheet to sheet. Other variations include placing the array sensor at a diagonal, or using a smaller array sensor and moving that into position for different paper widths.

Figure 3:
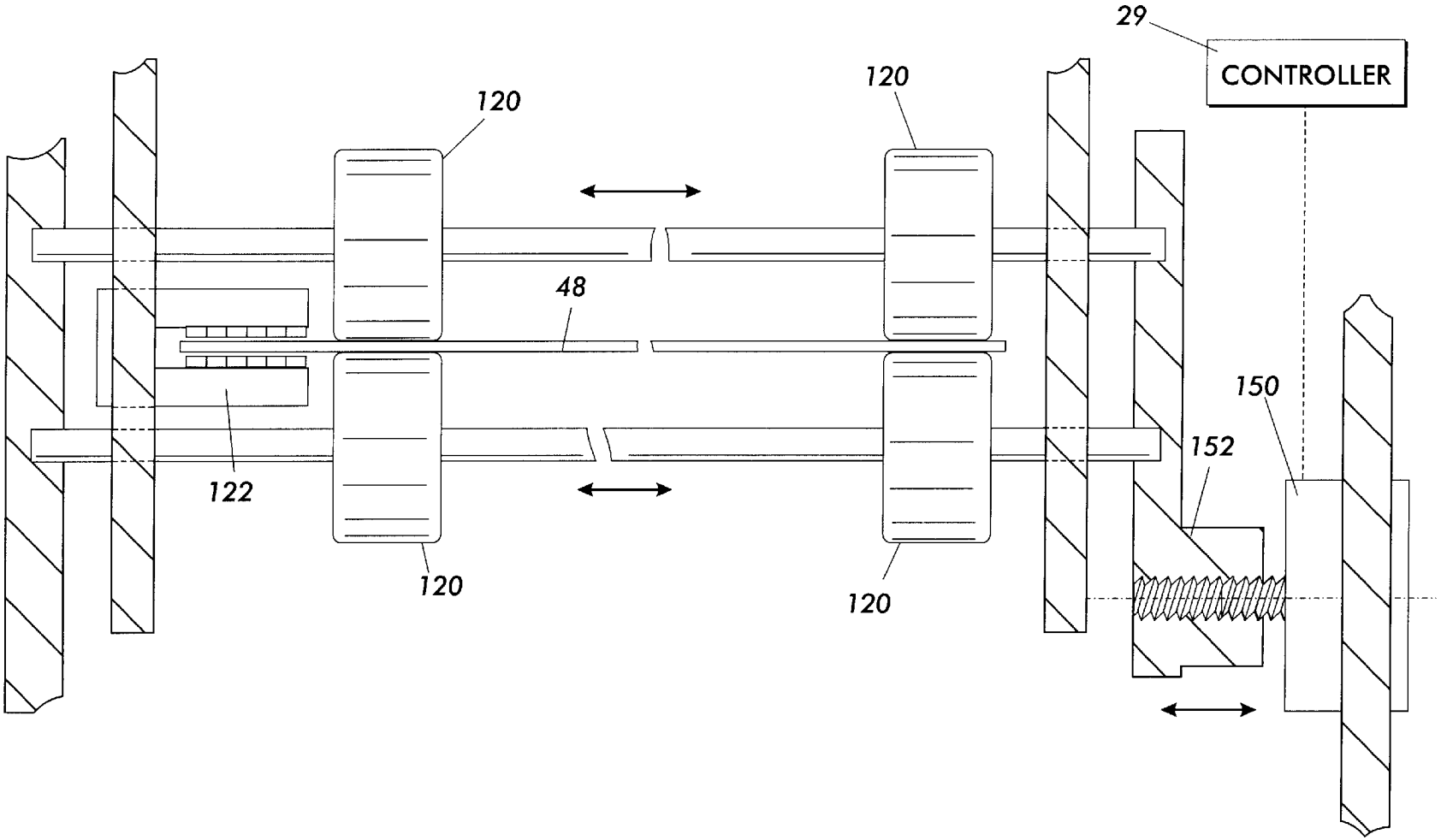
FIG. 3 is an elevational view of the pretransfer nip utilizing the translating nip mechanism with the array sensor.

Another significant use of the array sensor to detect top edge is when used in conjunction with the translating electronic registration systems as illustrated in FIG. 3. Normally, these systems are used for edge registered paper paths. A "point" sensor is used to detect the sheet edge. The sheet is translated inboard or outboard until this point sensor is tripped. The system overtravels, then reverses to recover the overtravel distance. All of this overtravel correction takes time. And all of this must be accomplished within the time it takes to move the lead edge of the sheet from registration to touchdown on the photoreceptor, immediately before transfer. To minimize the time to correct for overtravel, or to increase the top edge correction amount, the array sensor 122 operates as follows: When the edge is detected, it will be well ahead of the virtual top edge registration line. The stepper motor 150 which drives the translating carriage 152 is controlled by an algorithm that can plan ahead and decelerate down to zero velocity at the exact correct time such that no overtravel occurs. This corrective method when used in combination with the start of scan correction method described above allows even greater corrective latitude.

While the invention herein has been described in the context of a black and white printing machine, it will be readily apparent that the device can be utilized in any printing machine to align and register sheets.

In recapitulation, there is provided an apparatus and method for correcting top edge sheet misregistration using a sensor array. An array sensor is placed in the paper path prior to transfer. A signal is generated indicating the position of the sheet. As a function of the signal the print controller causes the image to be exposed and developed on the photoreceptor in alignment with the sheet position. The aligned image is then transferred to the sheet It is, therefore, apparent that there has been provided in accordance with the present invention, a sheet registration apparatus and method that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus to correct misregistration of a sheet in a printer, comprising:

an integral array sensor, to measure the position of a sheet and to generate a first signal indicative thereof;

a controller, to receive the first signal from said array sensor and to generate a corrected print signal as a function thereof;

a print engine, responsive to the corrected print signal from said controller to create marks on a sheet in proper registration on the sheet; and a sheet translating device, for moving a sheet transverse to a sheet feeding direction along a sheetpath, said sheet translating device being responsive to a signal generated by said controller as a separate function of said first signal generated by said array sensor so that the sheet is moved into proper registration position prior to marking thereon.

2. An apparatus according to claim 1 wherein said sheet translating device comprises a nip which is moveable transverse to the sheet feeding direction while the sheet is engaged in the nip.

3. An electrophotographic printing machine having an apparatus to correct misregistration of a sheet in a printer, comprising:

an integral array sensor, to measure the position of a sheet and to generate a first signal indicative thereof;

a controller, to receive the first signal from said sensor and to generate a corrected print signal as a function thereof;

a sheet translating device, responsive to a transverse positioning signal generated as a function of the first signal, for moving a sheet transverse to a sheet feeding direction along a sheetpath so that the sheet is moved into proper registration position prior to marking thereon; and a print engine, responsive to the corrected print signal from said controller to create marks on a sheet in proper registration on the sheet.

4. An electrophotographic printing machine having an apparatus to correct misregistration of a sheet in a printer, comprising:

an integral array sensor, to measure the position of a sheet and to generate a first signal indicative thereof;

a controller, to receive the first signal from said array sensor and to generate a corrected print signal as a function thereof;

a print engine, responsive to the corrected print signal from said controller to create marks on a sheet in proper registration on the sheet; and a sheet translating device, for moving a sheet transverse to a sheet feeding direction along a sheetpath, said sheet translating device being responsive to a positioning signal generated by said controller as a separate function of said first signal generated by said array sensor so that the sheet is moved into proper registration position prior to marking thereon.

5. A printing machine according to claim 4 wherein said sheet translating device comprises a nip which is moveable transverse to the sheet feeding direction while the sheet is engaged in the nip.

6. A method of determining the position of and correcting misregistration of a sheet in a printer, comprising:

measuring the position of a sheet with an integral array sensor and generating a signal indicative thereof;

generating a corrected print signal as a function of the signal from said sensor;

moving a sheet transverse to a sheet feeding direction along a sheetpath in response to a translation signal generated as a function of the signal from said sensor; and creating marks on a sheet in proper registration on the sheet responsive to the generated corrected print signal.

* * * * *